US005517797A

United States Patent [19]

Ballard et al.

[11] Patent Number: 5,517,797

[45] Date of Patent: May 21, 1996

[54] ENVELOPE POSITIONING APPARATUS FOR INSERTING MACHINE

[75] Inventors: Michael D. Ballard, Sandy Hook; Sung S. Chang, Stamford; Joseph H. Marzullo, Brookfield; Steven A. Supron, Prospect, all of Conn.

[73] Assignee: Pitney Bowes Inc., Stamford, Conn.

[21] Appl. No.: 356,742

[22] Filed: Dec. 15, 1994

[51] Int. Cl.[6] ..... B65B 43/26; B65B 43/42; B65B 57/00

[52] U.S. Cl. ..... 53/64; 53/381.5; 53/569

[58] Field of Search ..... 53/64, 67, 55, 53/52, 569, 460, 206, 284.3, 381.5, 168; 209/597, 598, 900, 7

[56] References Cited

U.S. PATENT DOCUMENTS

| | | | |
|---|---|---|---|
| 1,916,847 | 7/1933 | McCarthy . | |
| 2,384,506 | 9/1945 | Thompson | 53/206 X |
| 2,914,895 | 12/1959 | Martin | 53/95 |
| 3,886,715 | 6/1975 | Dorer | 53/384 |
| 4,020,615 | 5/1977 | Irvine et al. | 53/67 X |
| 4,852,334 | 8/1989 | Auerbach | 53/569 |
| 4,903,456 | 2/1990 | Meur | 53/569 X |
| 5,042,223 | 8/1991 | Gerbaud | 53/55 |
| 5,168,689 | 12/1992 | Macelis | 53/569 |
| 5,247,780 | 9/1993 | Kulpa et al. | 53/381.5 |
| 5,255,498 | 10/1993 | Hotchkiss et al. | 53/569 |

*Primary Examiner*—James F. Coan
*Attorney, Agent, or Firm*—Robert H. Whisker; Ronald Reichman; Melvin J. Scolnick

[57] ABSTRACT

An apparatus for properly positioning envelopes in an envelope inserting machine for receiving insert material is disclosed in which the envelope positioning apparatus feeds a first envelope along a prescribed feed path to a predetermined location which is beyond the normal location at which the throat of the envelope can be opened so that the envelope can receive a package of insert material, and then feeds the envelope in a reverse direction until a throat opening device is effective to open the throat of the first envelope. A microprocessor, which controls the feeding of the envelope, is preset to feed the envelope to the first mentioned predetermined location, and has the capability to adjust the preset amount by which the envelope is fed by the amount that it is fed in the reverse direction so that all succeeding envelopes having the same shape and throat characteristics as the first envelope are fed direction to the location at which the throat of the first envelope is opened to receive the insert material.

9 Claims, 9 Drawing Sheets

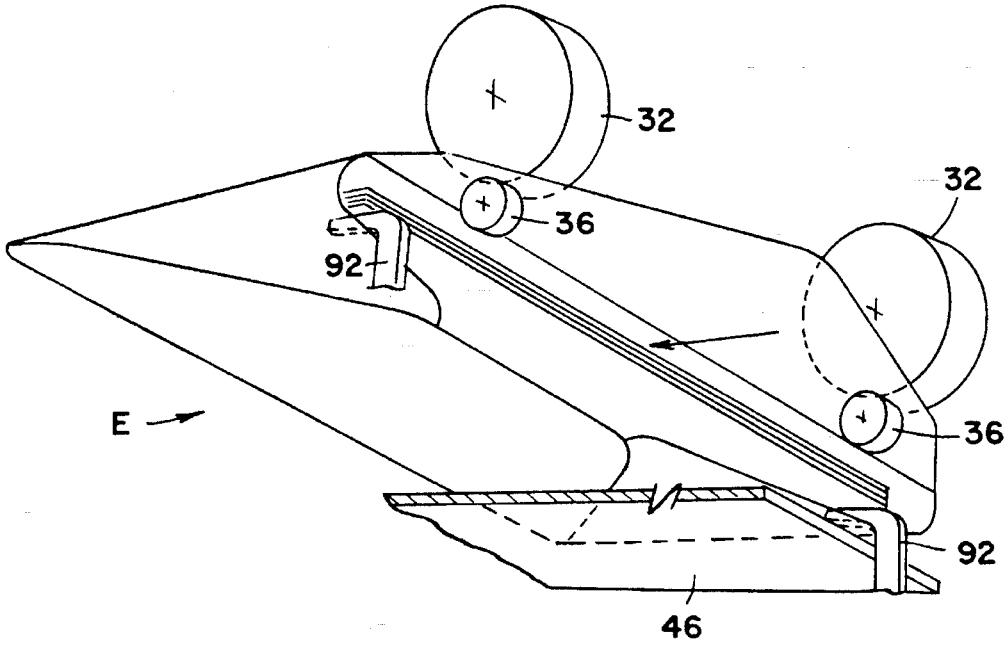
FIG. 2
FIG. 3
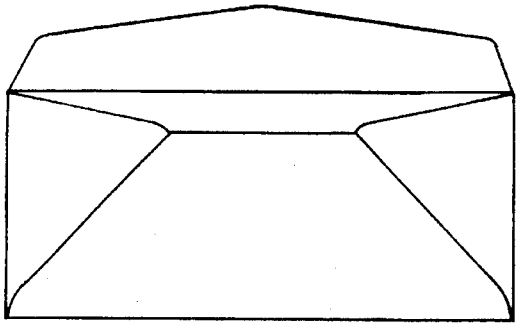
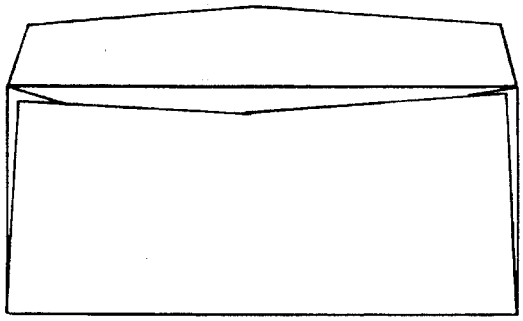
FIG. 4
FIG. 5
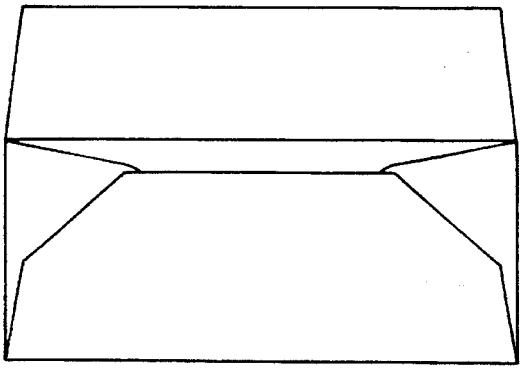

ENVELOPE POSITIONING APPARATUS FOR INSERTING MACHINE

BACKGROUND OF THE INVENTION

This invention relates generally to the field of inserting machines, and more particularly to an apparatus for positioning envelopes having various shape and throat characteristics in an inserting machine so that insert material can be inserted into the different envelopes without causing the inserting machine to malfunction.

This invention is an improvement on the envelope inserting apparatus disclosed and claimed in U.S. Pat. No. 4,852,334, issued on Aug. 1, 1989 to David R. Auerbach, and assigned to the assignee of this application.

Envelope inserting machines have long been well known and have achieved a significant degree of commercial success, since they significantly increase the speed at which various forms of sheet material can be inserted into envelopes prior to the envelopes being inserted into a mailing machine where the flaps are closed and sealed and a postage indicia is applied to the envelopes.

Although there are a wide variety of envelope inserting machines both commercially available and in the prior art, a significant problem associated with all such machines is that of ensuring that the throat of the envelope is open sufficiently wide to receive the insert material. In actual practice, the type and quantity of sheet material typically inserted into envelopes by inserting machines of the type with which the present invention is concerned ranges from a single sheet, either shaped to fit within the envelope or folded to fit, to a plurality of such sheets, with perhaps single or folded inserts contained within the folded sheets, and running perhaps one eighth to one quarter of an inch thick. With this type of bulk material being inserted into the envelope, it becomes critical that the throat of the envelope be opened sufficiently wide so that the material will enter the envelope without snagging or catching on any portion of the edge of the envelope throat. Should this happen, the envelope becomes rumpled, the insert material becomes disarrayed and a serious paper jam occurs in the machine which usually requires that the machine be shut down, that various access doors or panels be opened, or portions of the machine be separated from other portions to render the area of the jam accessible to an operator for clearing, during all of which the inserting machine is inoperable. It will be apparent that this can have serious consequences if the inserting machine is on line with other machines, such as a collator and folder combination that forms the insert package for the inserting machine, and a continuous through put mailing machine for receiving the filled envelope from the inserting machine for closing and sealing the envelope and applying a postage indicia thereto.

Various attempts have been made in prior machines to address the problem of properly opening envelope throats so as to consistently receive insert material without causing misfeeds or jams, and most if not all of these attempts have met with varying degrees of success. Thus, virtually all of the inserting machines in commercial use today do effectively open envelope throats properly, that is, the envelope throats are opened by the throat opening mechanism on the first try and to an extent sufficient to accept the amount of material that is being inserted. In normal practice, the envelope is fed to a stop member which places the envelope in a predetermined position in which one of various forms of envelope throat opening devices spreads the non-flapped side of the envelope away from the flapped side to open the throat, after which the insert package is pushed into the envelope by a suitable pusher assembly. The throat opening devices then release the envelope, the stop is moved out of the path of movement of the envelope, and the filled envelope is ejected from the inserting machine for further processing.

In order for this process to occur, it is necessary to adjust the position of the stop member in the direction of feed of the envelope so that the upper edge of the non-flapped side of the envelope is in the precise predetermined position where the picker devices will catch on the upper edge of the non-flapped side of the envelope to open the throat. This typically involves placing an envelope into the inserting machine and manually positioning it back and forth by small increments in the direction of feed of the envelope, while also manually moving the picker devices back and forth during the actual envelop edge catching portion of the cycle of operation of the picker devices, until the operator is satisfied that the picker devices will properly catch on the upper edge of each succeeding envelope during a run to open all of them properly. Once the back stop has been properly adjusted for a particular envelope and is locked in position, the inserting machine will normally operate without further adjustment or difficulty.

The problem that arises is that the extent of the reliability of the envelope throat opening devices to perform their intended function is affected by the wide variety of shapes and configurations of envelopes that are available for normal business and private use, and the inserting machine may require adjustment as described above for each different type of envelope being used. For example, considering the typical #10 envelope so frequently used for business, any variation in the width of the envelope measured from the bottom to the crease line between the flap and the upper surface of the envelope will obviously vary the position of the envelope at the inserting location if the stop member remains in the same position. Also, and perhaps of greater significance, there is substantial variation in the shape of the non-flapped side of envelopes, some of which extend from the bottom edge thereof to a line substantially coincident with the crease line between the flap and the flapped side of the envelope, while other non-flapped sides have upper edges that extend downwardly from a position of coincidence with the crease line in various forms of V configurations. For example, on some envelopes, the non-flapped upper edge extends almost straight across the envelope for a short distance and then angles downwardly rather gradually to the center of the envelope. On others, the same upper edge may extend downwardly into the V configuration rather steeply and directly from the outer edge corners. A further factor that affects the reliability of the envelope flap opening device is the differences in the shape and/or configuration of envelopes due only to manufacturing tolerances, which in some instances can cause variations of as much as plus or minus one sixteenth of an inch.

As long as the inserting machine is readjusted as described above each time a different type of envelope is utilized, no difficulty is likely to be encountered be encountered in the operation of the inserting machine. And, of course, if the inserting machine is being used in connection with runs of many thousands of envelopes of the same shape and throat configuration, such repeated adjustment would not present a significant problem. However, the problem that often arises is that an operator, or some other person not familiar with the inserting operation currently running, may insert an envelope into the current run that has a different shape or throat configuration than that of the envelopes currently running, and the inserting machine may not be adjusted to properly open the throat on that envelope, thereby resulting in a jam with the consequences described above. The same result would occur if an operator changed to a different type of envelope from that of a previous run and did not readjust the inserting machine for the new envelope before starting a new run.

In view of the foregoing, there is obviously a need for an inserting machine that can recognize variations in shape and throat characteristics of envelopes and that can automatically position envelopes in response to such recognition so that the picker devices will properly open the throat of the different envelopes to receive the insert package. It should be apparent that an inserting machine with this type of capability would rarely if ever malfunction due to a change in the shape and throat characteristics of different envelopes.

BRIEF SUMMARY OF THE INVENTION

The foregoing problems and disadvantages of prior art inserting machines are substantially obviated, if not entirely eliminated, by the present invention which renders the inserting machine capable of recognizing differences in the shape and throat characteristics of various types of envelopes, and which automatically adjusts the inserting position of the envelopes in the inserting machine so that they will be properly positioned for accepting the insert package.

In its broader aspects, the present invention comprises an envelope positioning apparatus for positioning envelopes having various shape and throat characteristics in an inserting machine so that the envelope throats can be opened for receiving insert material regardless of variations in the shape and throat characteristics of envelopes that are successively fed into the inserting machine. In this environment, the envelope positioning apparatus comprises guide means defining a feed path along which envelopes are adapted to be fed and to be disposed in a predetermined insert material receiving location for receiving insert material therein, means for feeding envelopes along the feed path, means disposed along the feed path for opening the throat of envelopes that are in the insert material receiving location that is appropriate for the shape and throat characteristics of the envelopes being fed along the feed path, and a sensing means disposed along the feed path for sensing the arrival of the lead edge of a first envelope at a first predetermined location along the feed path. There is a microprocessor control means operable in response to the sensing means sensing the arrival of the lead edge of the first envelope at the first predetermined location for (1) causing the feeding means to position the first envelope at the insert material receiving location, (2) causing the feeding means to feed successive envelopes having the same shape and throat characteristics as the first envelope to be fed to the same insert material receiving location, and (3) causing the feeding means to feed successive envelopes having shape and/or throat characteristics different from those of preceding envelopes to be fed to a different insert material receiving location that is appropriate to the different shape and/or throat characteristics, with the result that each succeeding envelope fed into the inserting machine having the same shape and throat characteristics will be positioned in the initial insert material receiving location, and any envelope not having the same shape or throat characteristics will be automatically repositioned to a different insert material receiving location to receive insert material thereat.

In some of its more limited aspects, the feeding means comprises a pair of cooperating feed rollers, one of which is driven by a stepper motor that is under the control of the microprocessor control means. The microprocessor control means comprises means responsive to the sensing means for causing the feeding means to feed the first envelope along the feed path until the lead edge thereof reaches a second predetermined location at which the first envelope is disposed beyond the predetermined insert material receiving location appropriate for the first envelope. The microprocessor control means also includes a means response to the means for opening the throat of the first envelope not being effective to open the throat for causing the feeding means to feed the first envelope in a reverse direction along the feed path until the lead edge of the first envelope is in a third predetermined location at which the envelope is in the predetermined insert material receiving location where the means for opening the throat of the first envelope is effective to open the throat. The microprocessor control means further includes means for adjusting the distance that the feeding means feeds the envelope to move the lead edge thereof from the first predetermined location by the distance that the envelope is moved in the reverse direction to move the lead edge thereof from the second predetermined location to the third predetermined location so that all succeeding envelopes having the same shape and throat characteristics are fed along the feed path until the lead edges thereof are in said third predetermined location, thereby placing the successive envelopes in the insert material receiving location appropriate for those envelopes.

Having briefly described the general nature of the present invention, it is a principal object thereof to provide an envelope positioning apparatus for an inserting machine having the capability of recognizing differences in the shape and throat characteristics of various types of envelopes, and automatically adjusting the insert material receiving location of the envelopes in the inserting machine so that they will be properly positioned for accepting the insert package.

It is another object of the present invention to provide an envelope positioning apparatus for an inserting machine in which a microprocessor control means is effective to establish a proper insert material receiving location along a feed path in the inserting machine for a first envelope having certain shape and throat characteristics, and for causing succeeding envelopes fed into the inserting machine and having substantially the same shape and throat characteristics to be fed to the same insert material receiving location.

It is still another object of the present invention to provide an envelope positioning apparatus for an inserting machine in which the microprocessor control means is effective to treat each succeeding envelope on which the envelope throat opening device does not open the throat as a new envelope having different shape and/or throat characteristics, and to automatically reposition the insert of the envelope so that the throat opening device is effective to open the throat of the succeeding envelope.

These and other objects and advantages of the present invention will be more apparent from an understanding of the following detailed description of a presently preferred embodiment of the present invention, when considered in conjunction with the accompanying drawings.

BRIEF DESCRIPTION OF THE DRAWINGS

FIG. 2 is a perspective view of an envelope located in the envelope positioning and throat opening mechanisms, looking at the open throat of the envelope with insert material therein.

FIG. 3 is a rear elevation of a typical #10 envelope showing one form of throat and flap configuration.

FIG. 4 is a view similar to FIG. 3 showing a #10 envelope having a different throat and flap configuration.

FIG. 5 is a view similar to FIGS. 3 and 4 showing a #10 envelope having a still different throat and flap configuration.

DETAILED DESCRIPTION OF THE INVENTION

Figure 1:
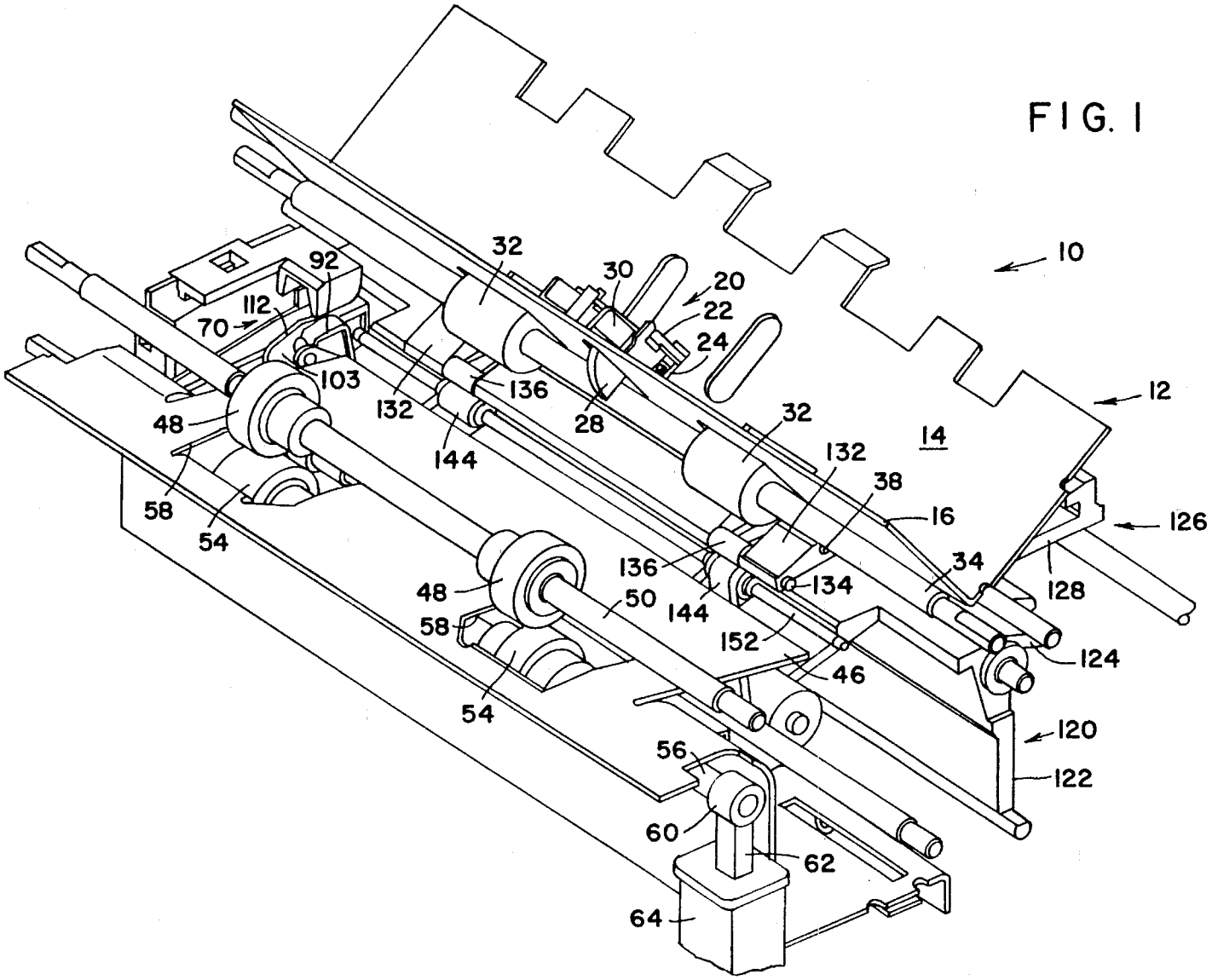
FIG. 1 is a perspective view of the major operating components of the inserting machine of the present invention.
Figure 6:
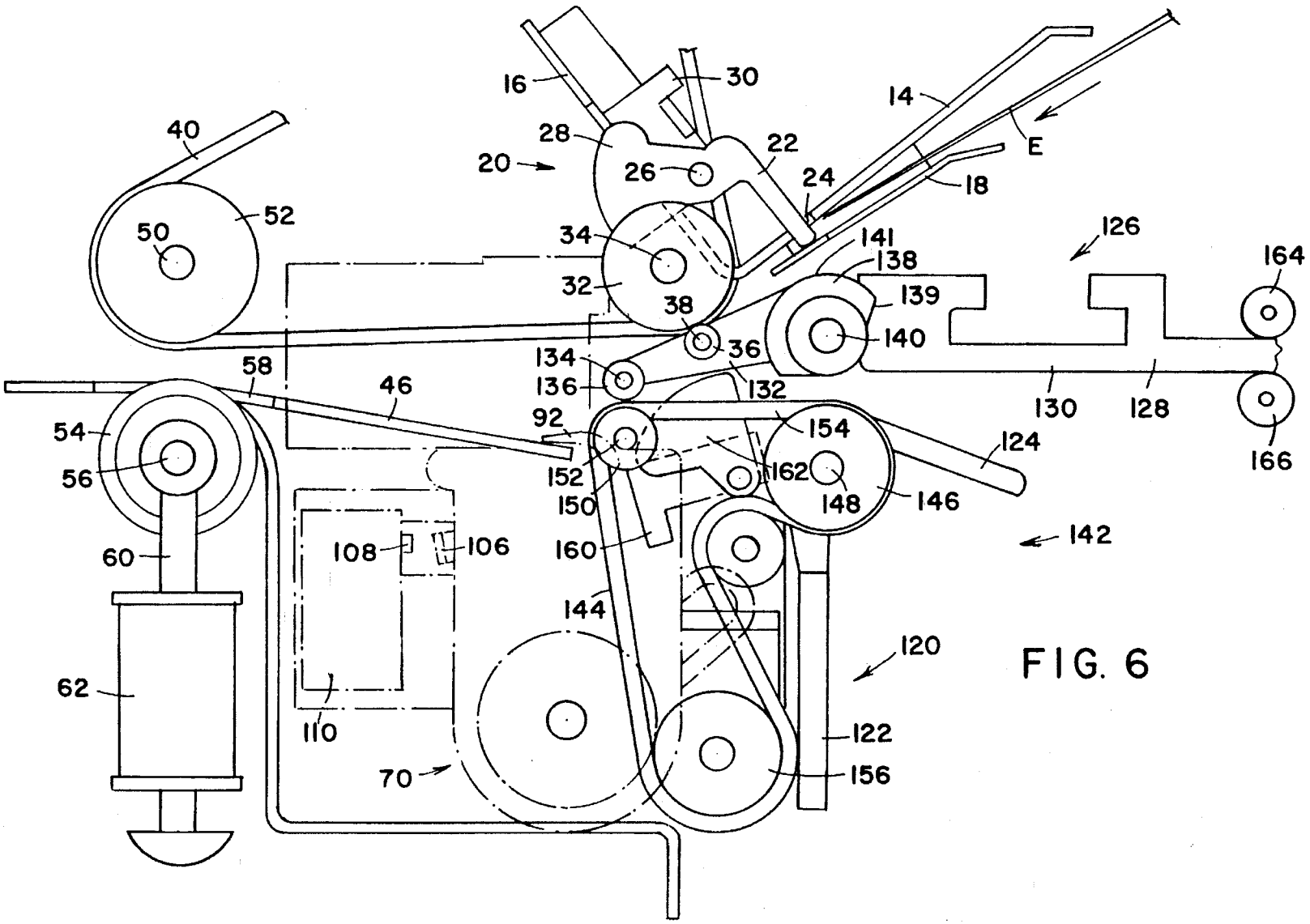
FIG. 6 is a side view of the mechanism shown in FIG. 1, showing an envelope being fed into the throat opening and positioning mechanism.

Referring now to the drawings, and particularly to FIGS. 1 and 6 thereof, the envelope positioning apparatus of the present invention is therein designated generally by the reference numeral 10. It will be understood that all of the structure hereinafter described is suitably mounted in a frame forming part of the inserting machine of which the envelope positioning apparatus 10 is a component; accordingly, only so much of the structure of the inserting machine as is necessary to an understanding of the present invention is included herein.

A generally V-shaped guide plate, designated generally by the reference numeral 12, is suitably mounted on the frame, the guide plate 12 having a first slanted wall 14 which forms part of a feed path for envelopes being fed through the envelope positioning apparatus 10, and a second slated wall 16 which provides suitable support for certain control elements hereinafter fully described. Another guide plate 18 (FIG. 6) is mounted beneath the wall 14 of the guide plate 12 and in spaced relationship therewith, such that the wall 14 and the wall 18 define a part of a feed path into which envelopes, such as represented by the envelope E (FIG. 6), are fed in succession. It will be understood, as is well known in the art, that the inserting machine has means for feeding individual envelopes from a supply thereof, and for opening the flaps of the envelopes prior to their being fed into the inserting area of the inserting machine. Thus, the envelopes, again as represented by that designated E in FIG. 6, have already been fed through the initial feeding means of the inserting machine and the flaps of the envelopes have been opened.

A sensing switch, designated generally by the numeral 20 is mounted on the wall 16 of the guide member 12, and includes an envelope sensing lever 22 which projects downwardly through an aperture 24 in the wall 14 to as to be disposed in the path of movement of the envelope E. The sensing lever 22 is pivotally mounted, as at 26, so that an arm 28 thereof is moved upwardly toward a switch 30 which is activated to a closed position by clockwise movement of the sensing lever 22 when an envelope E moves past the lower end of the sensing lever 22. As further explained below, the function of the sensing lever 22 and the switch 30 is to initiate operation of a microprocessor control means for positioning the envelope E in a desired location, depending on the shape and throat characteristics of the envelope, to enable a throat opening device to open the throat of the envelope E.

Figure 7:
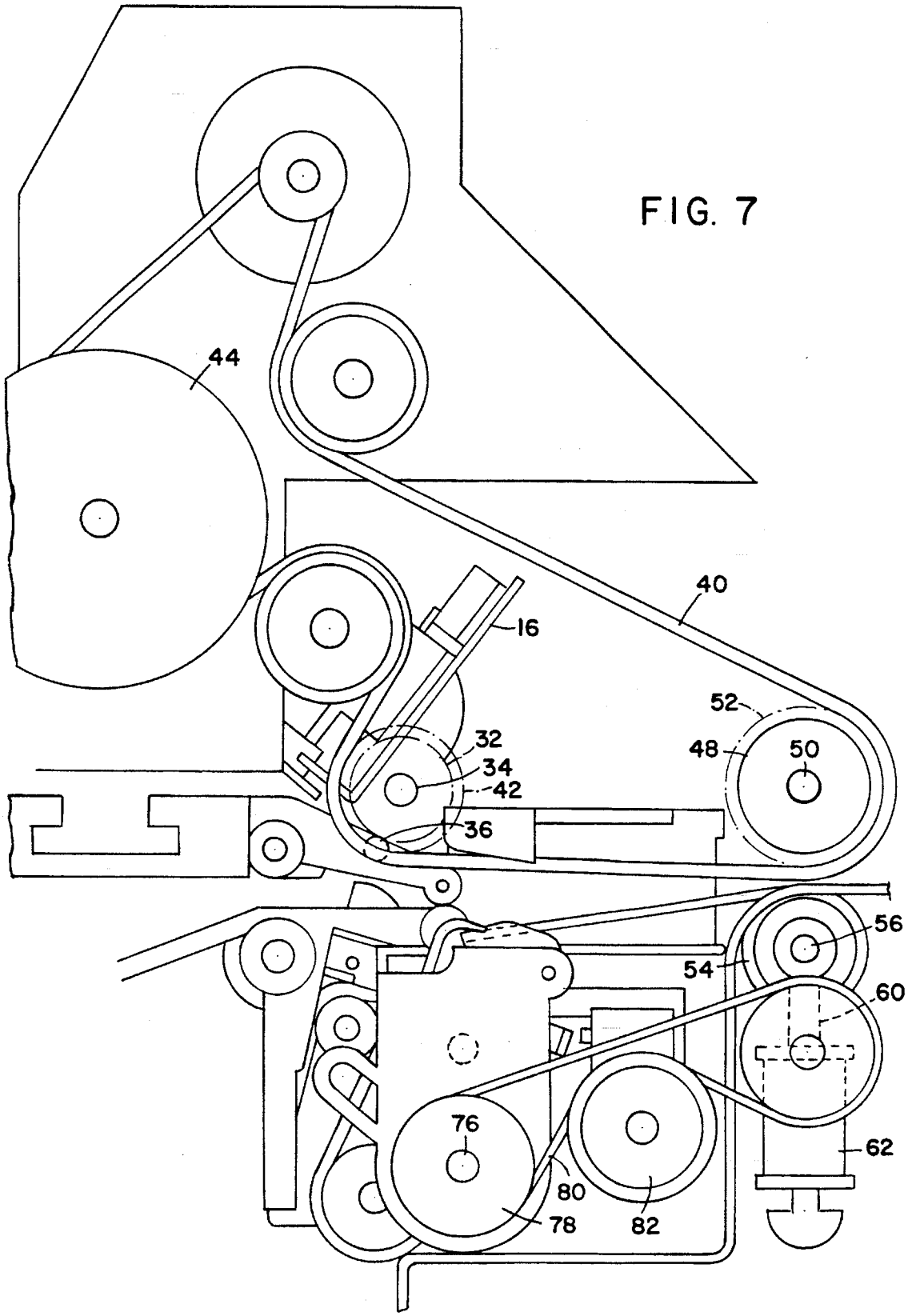
FIG. 7 is a view similar to FIG. 6 looking at the opposite side of the mechanism, and showing the drive assembly for the envelope feeding means and the throat opening device.

Still referring to FIGS. 1 and 6, a pair of feed rollers 32 are fixedly mounted on a shaft 34 for rotation therewith, and a pair of back up rollers 36 are rotatably mounted on a shaft 38 fixedly mounted in the frame. As best seen in FIG. 7, the shaft 34 is driven by a belt 40 which passes around a pulley 42 fixedly mounted on one end of the shaft 34, the belt 42 being driven by a stepper motor 44, the belt 40 also driving other components as further explained hereinbelow.

Figure 8:
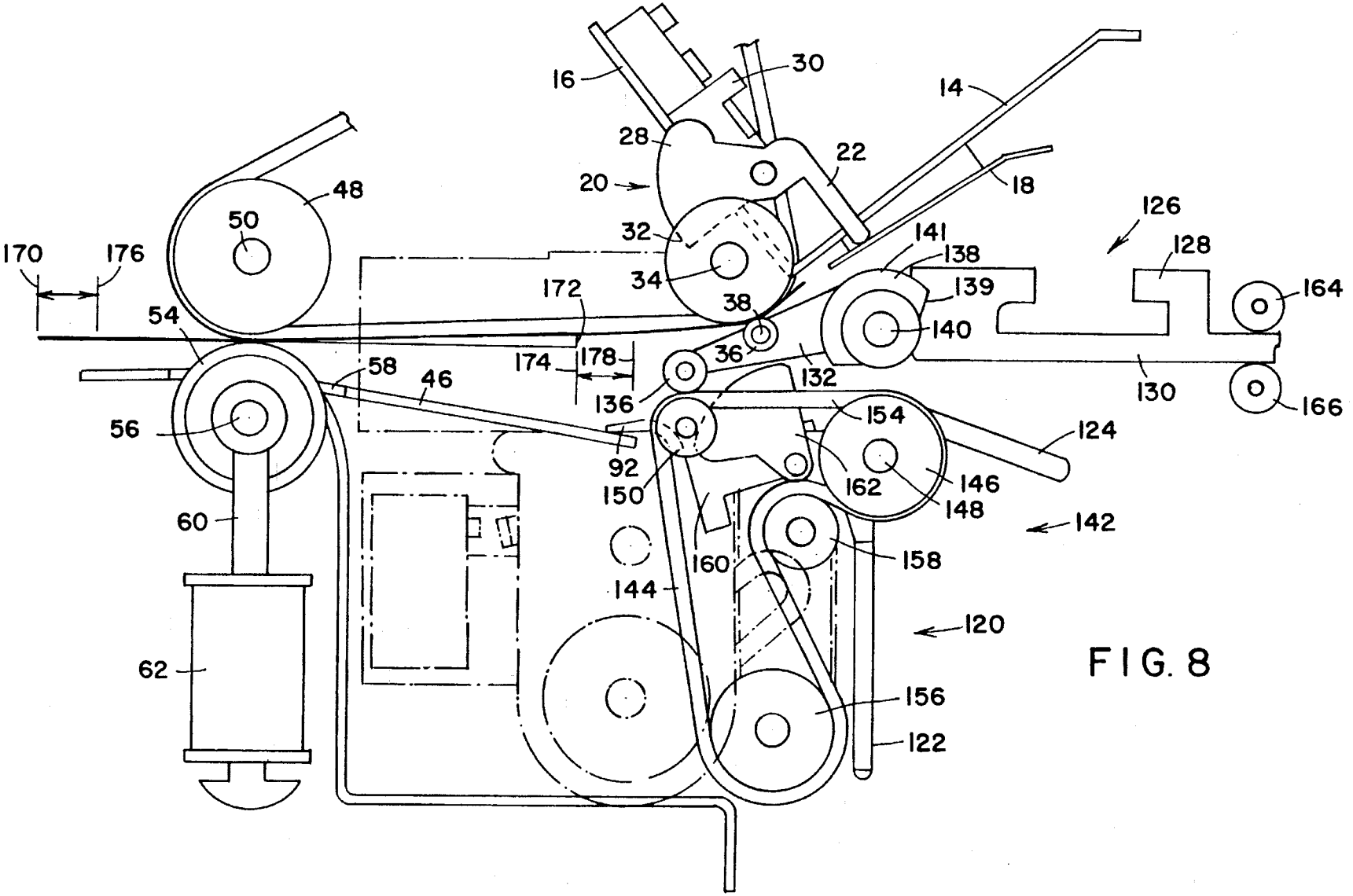
FIG. 8 is a view similar to FIG. 6, but showing an envelope in the initial predetermined position to which it is fed.

Referring now to FIGS. 1 and 6 through 8, another guide plate 46 is mounted slightly beneath and spaced in the downstream direction of an envelope E so that the lead edge of the envelope engages the guide plate 46 as the envelope is fed along the feed path defined thus far by the walls 14 and 18 and the feed rollers 32 and back up rollers 36. A pair of feed rollers 48 are fixedly mounted on a shaft 50 which is rotatably driven by the belt 40 passing around a pulley 52. A pair of back up rollers 54 are rotatably mounted on a shaft 56 mounted below the guide plate 46, and which project upwardly through apertures 58 in the guide plate 46 to engage with the feed rollers 48 when the shaft 56 is in an upper position, as shown in FIG. 1. As best seen in FIGS. 6 and 8, the ends of the shaft 56 are mounted on the upper ends of solenoid plungers 60 which extend through a pair of solenoids 62. It will be seen, by comparing FIG. 6 with FIG. 8, that when the solenoids 62 are energized, the feed lower feed rollers 54 are brought into feeding engagement with the feed rollers 48 to eject envelopes from the apparatus 10 after receiving insert material, as fully explained hereinbelow.

Referring now to FIGS. 1, 6 and 9 through 11, it will be seen that a pair of envelope throat opening devices, designated generally by the reference numeral 70, are mounted on opposite sides of and generally beneath the plate 46 adjacent the upstream end thereof and beneath and slightly downstream of the feed rollers 32 and back up rollers 36. The throat opening devices function to pick the upper edge of the rear or non flapped surface of an envelope and draw the edge downwardly while the upper surface and the flap of the envelope are maintained in an upper position, as seen in FIG. 2, thereby opening the throat the permit insert material to be inserted into the envelope, all as now to be fully explained. The envelope throat opening devices 70 each include a housing 72 (FIG. 9) which encloses a driving gear 74 fixedly mounted on a shaft 76 which is journaled for rotation in the housing 72, the shaft 76 extending outside of the housing 72 on one side thereof (FIG. 7) on which is mounted a pulley 78 driven by a belt 80, which in turn is driven by a motor 82. The housing 72 also encloses a driven gear 84 which is rotatably mounted on a suitable bearing 86 such that the driven gear 84 meshes with the driving gear 74.

One end of an elongate link 88 is pivotally mounted on a pin 90 carried eccentrically by the gear 84, and the other end of the link 88 carries a hook 92 that is bent over at almost a right angle to the long dimension of the link 88. One end of a lever 94 is pivotally mounted on a pin 96 mounted on an intermediate portion of the link 88, the other end of the lever 94 being pivotally connected to another pin 98 which passes through a slot 100 formed in a switch actuator plate 103 and is mounted in the housing 72. The switch actuator plate 103 is pivotally mounted on a pin 104 also connected to the housing 72.

Figure 9:
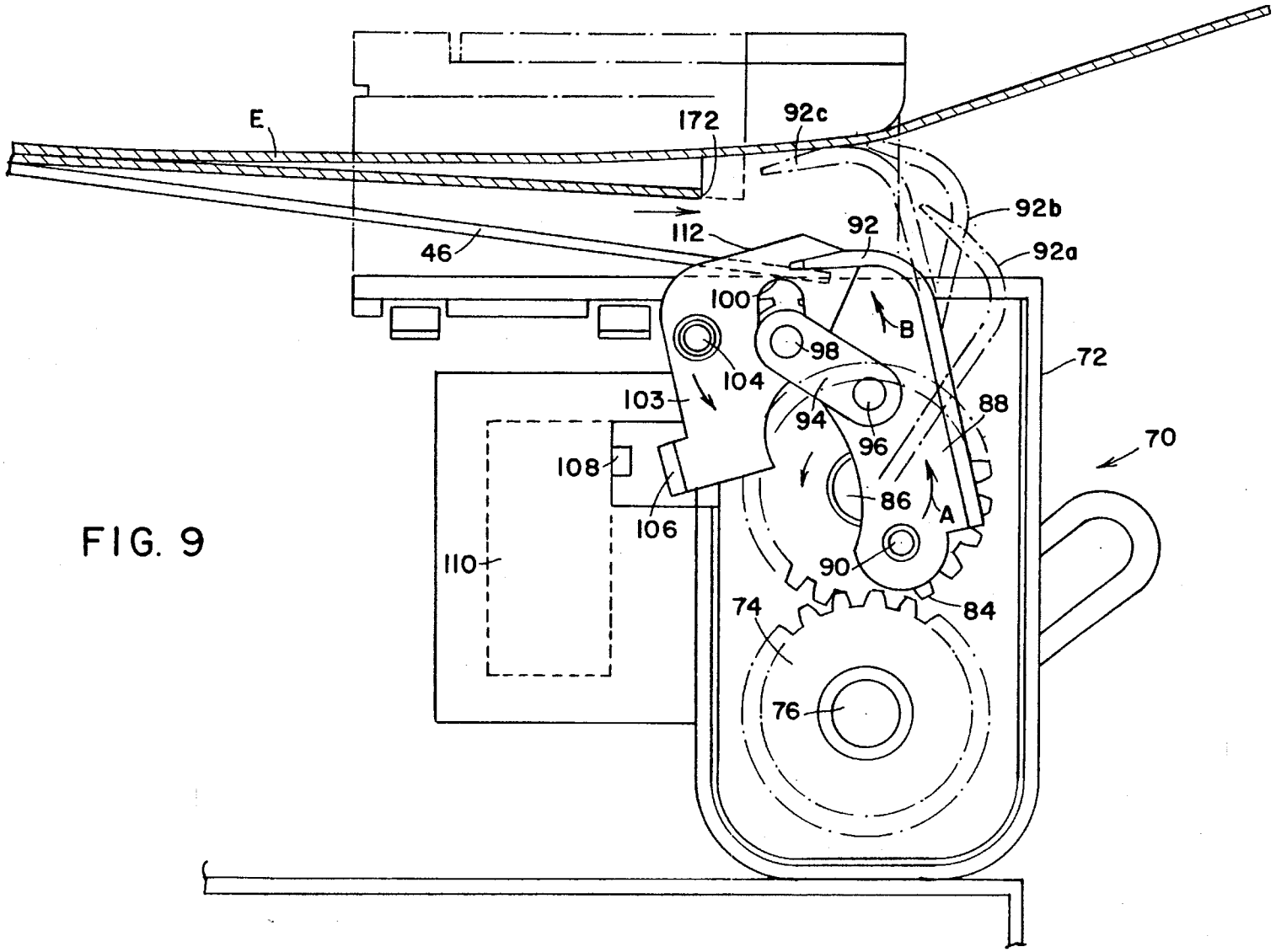
FIG. 9 is a view similar to FIG. 6, drawing to an enlarged scale, but showing the envelope in the throat opening device attempting to open the envelope throat.
Figure 10:
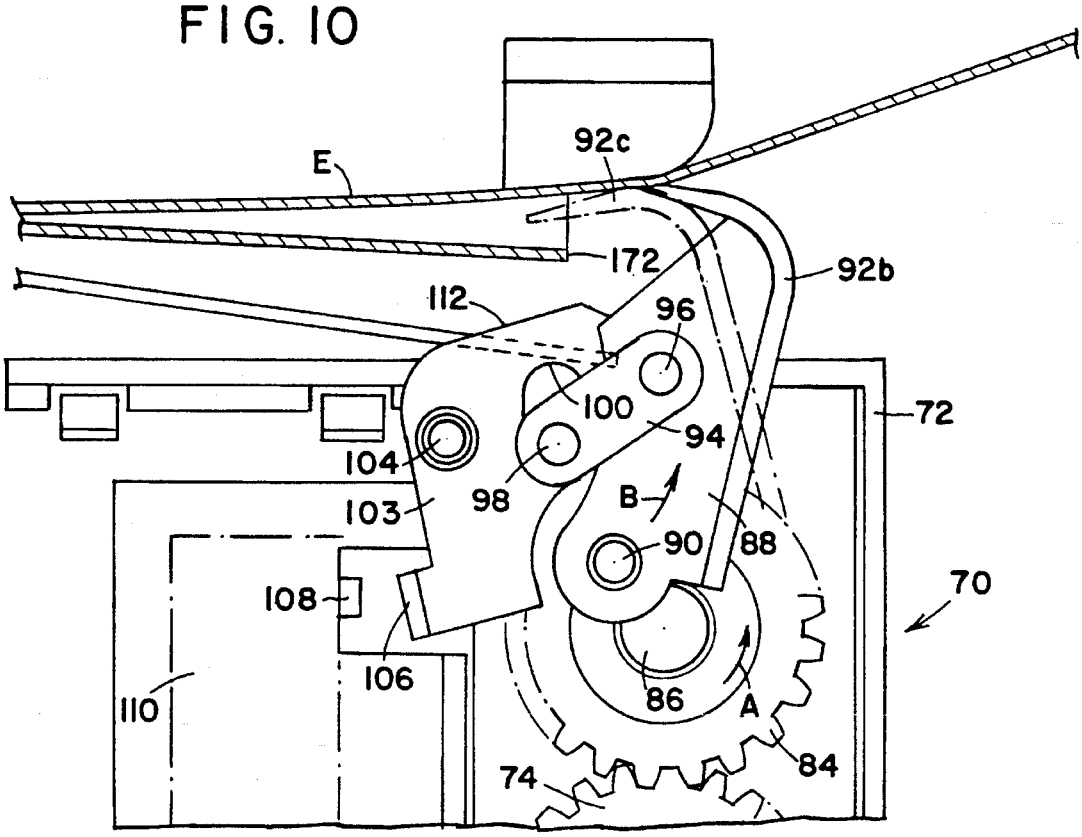
FIG. 10 is a view similar to FIG. 9, but showing the throat opening device engaged in the throat of an envelope and about to open the throat.
Figure 11:
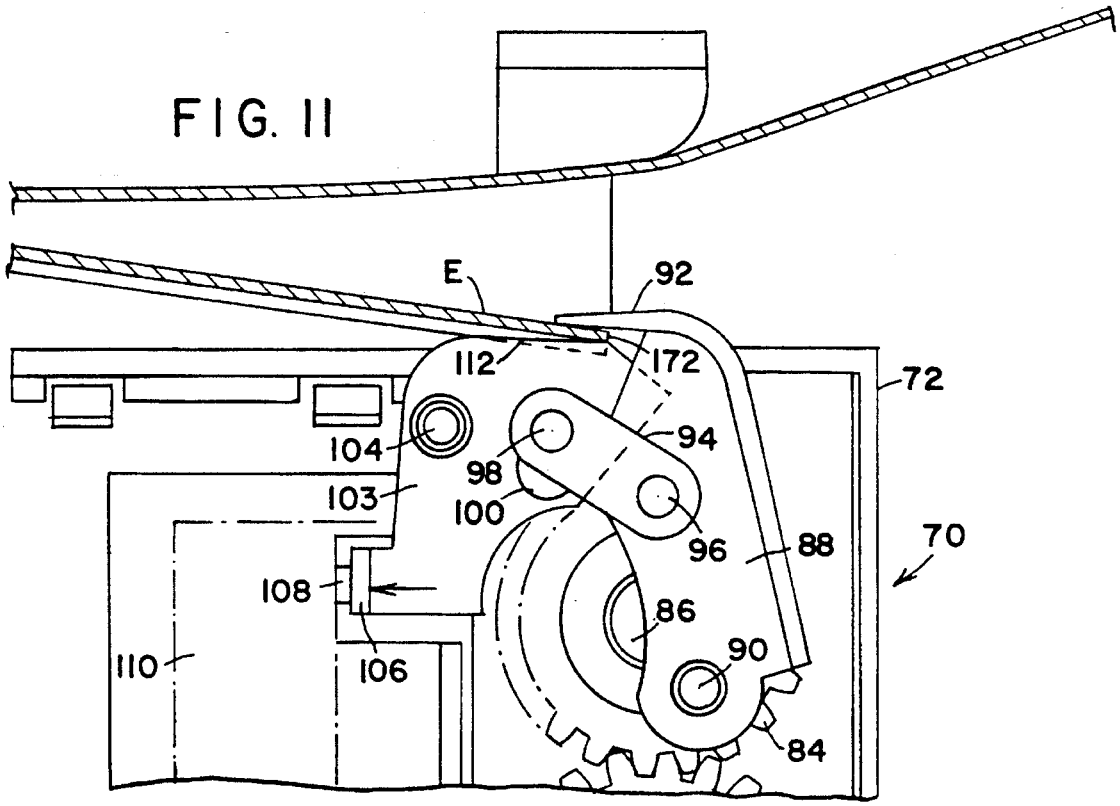
FIG. 11 is a view similar to FIG. 9, but showing the throat opening device holding the envelope throat fully open.

A partial description of the operation of the envelope throat opening device will now be presented with reference to FIGS. 9 through 11. It will be seen from FIG. 9 that when the driving gear 74 is rotated in a counter clockwise direction, the driven gear 84 is rotated in a clockwise direction, and the pin 90 follows an orbital path around the shaft 86 as indicated by the arrow A. Rotation of the pin 90 causes the lower end of the link 88 to follow the same orbital path as the pin 90, but since the link 88 is connected by the pin 96 to the lever 94, which in turn is connected to the housing 72 by the pin 98, the pin 96 also follows an orbital path as indicated by the arrow B, and the link 88 is initially oscillated in a clockwise direction about the pin 90 as it moves upwardly from the position shown in FIG. 9 to cause the hook 92 to move from the solid line position to the first dotted line position indicated by the numeral 92*a*. Further rotation of the gear 84 causes the pins 90 and 96 to reach substantially uppermost positions, as shown in FIG. 10, which causes the link 94 to reach its uppermost position to bring the hook 92 to the second dotted line position 92*b* shown in FIG. 9 and the solid line position 92*b* shown in FIG. 10. Still further rotation of the gear 84 causes the link 88 to oscillate in a counter clockwise direction about the pin 90 which now causes the hook 92 to moved in a downstream direction with respect to the movement of envelopes along the feed path so that the hook 92 now reaches the dotted line position 92*c* in FIGS. 9 and 10. As will be more fully explained hereinbelow, this is the position in which the hook 92 of each throat opening device 70 engages the upper edge 172 of the non-flapped side of the envelope to open the throat. As the gear 84 completes one revolution and returns to the position shown in FIG. 9, the link 88 is pulled downwardly by the pin 90 so that the hook 92 is also pulled downwardly from the dotted line position 92*c* in FIGS. 9 and 10 to the solid line position 92 in FIGS. 9 and 11.

Still referring to FIGS. 6 and 9 through 11, it was mentioned previously that each throat opening device 70 include a switch actuator plate 103, the function of which is to provide a signal to the microprocessor that the hooks 92 have engaged the upper edge 172 of an envelope and opened the throat. Thus, it will be seen that the switch actuator plate 103 includes a switch engaging tab 106 disposed adjacent the lower end of the switch actuator plate 103, the function of which is to depress a movable switch arm 108 of a switch 110 when the switch actuator plate 103 is oscillated from a first position shown in FIGS. 9 and 10 in which the tab 106 is out of contact with the switch arm 108 to a second position shown in FIG. 11 in which the tab 106 is in contact with the switch arm 108 and has depressed the switch arm 108, thereby closing the switch 110. The switch actuator plate 103 includes suitable biasing means to normally maintain it in the first position shown in FIGS. 9 and 10, so that the switch 110 cannot be closed during repeated rotation of the gear 84 and oscillating cycles of the link 88 and hook 92 as explained above.

As best seen in FIG. 10, the link 88 and hook 92 are mounted on the pins 90 and 104 respectively so that they are in very close side by side relationship, with only sufficient clearance between them to permit relative side by side movement. However, the upper edge of the switch actuator plate 103 has a slanted surface 112 which is engaged by the lower surface of the upper edge 172 of an envelope E when the hooks 92 engage the opposite surface of the upper edge 172 of the envelope and pull the upper edge 172 downwardly during the fast portion of rotation of the gear 84, as explained above. This causes the switch actuator plate 103 to oscillate in a clockwise direction to move the tab 104 into contact with the switch arm 108, thereby depressing the latter to close the switch 110. Thus, the closing of the switch 110 signals the microprocessor that the throat of the envelope has been opened, as best seen in FIG. 11. It should be noted that a false signal that an envelope is properly positioned with the throat open and ready to receive insert material cannot be given to the microprocessor even if an envelope is fed onto the guide plate 46 in a skewed manner because the microprocessor requires a signal from the switch 110 in both throat opening devices 70 in order for it to recognize that an envelope is properly positioned to receive insert material.

Since the specific structure by which the package of insert material is inserted into the envelope is not a part of the present invention, it is hereinafter described only to the extent that it interacts with the present invention. With reference to FIGS. 1, 6 through 8 and 12, it will be seen that a generally T-shaped member, indicated generally by the reference numeral 120, extends across the envelope positioning apparatus 10 and is suitably mounted in the frame thereof for limited vertical movement. The member 120 has a vertically extending web 122, and a generally horizontal upper cross piece 124 which forms a supporting surface for the insert material as hereinafter more fully explained. Another member, indicated generally by the reference numeral 126, is mounted between the envelope positioning apparatus frame, this member having an elongate rear portion 128, the undersurface 130 thereof forming a guide surface for the insert material, also as hereinafter more fully explained. A pair of relatively short forwardly projecting extensions 132 support a shaft 134 on which is mounted a pair of back up rollers 136. A plurality of D-rollers 138 are mounted on a shaft 140 which is suitably driven under the control of the microprocessor as hereinafter described.

The T-shaped member 120 supports a pair of feeder assemblies, indicated generally by the reference numeral 142 in FIG. 6, each feeder assembly having a feed belt 144 which passes around a drive pulley 146 mounted on a shaft 148 which is suitably connected in driving engagement with the shaft 140 for the D-rollers 138. Thus, the pulleys 146 are driven in synchronism with the D-rollers 138. The belts 144 also pass around pulleys 150 rotatably mounted on a shaft 152 suitably mounted in the feeder assemblies 142 so as to present a substantially horizontal portion 154 of the belt 144. The belt 144 also passes around a lower pulley 156, and a small adjustably mounted pulley 158 which permits tension adjustment on the belt 144. A switch 160 is provided on each of the feeder assemblies, each switch having an actuator 162 pivotally mounted on the feeder assembly so as to be normally disposed in the path of movement of insert material and moved thereby from a position in which the switch 160 is not actuated to a position in which it is actuated. Finally, a pair of cooperating feed rollers 164 and 166 are mounted in the inserting machine component to feed the insert material to a standby position beneath the rear portion 128 of the member 126, as seen in FIG. 12.

Figure 12:
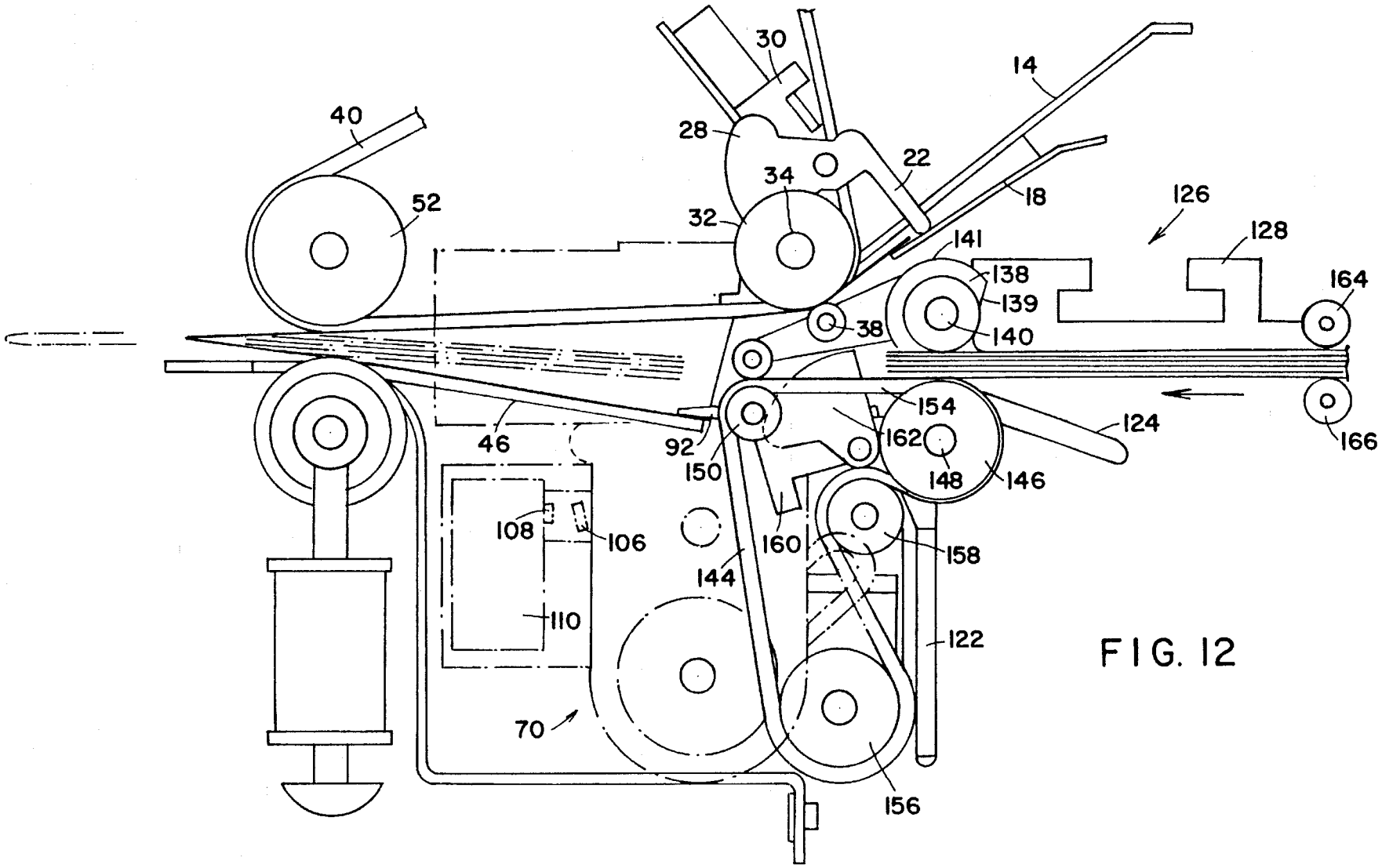
FIG. 12 is a view similar to FIG. 6 showing the envelope throat being held fully open and insert material being inserted thereinto.

With the parts and the insert material in the positions shown in FIGS. 6 and 12, it will be seen that when the microprocessor provides an appropriate signal to the drive element for the shaft 140, the D-rollers 138 are rotated in a clockwise direction to cause the material engaging surface 139 of each rollers to engage the upper surface of the insert material, thereby pressing the lower surface thereof against the upper surface of the belt 144 where it passes over the pulley 146. The entire feeder assembly 142 can then move downwardly to accommodate the thickness of the insert material between the peripheral surface 141 of the D-roller and the upper surface of the belt 144. The insert material then moves along the upper run 154 of the belt 144 and between the nip of the belt 144 and the back up rollers 136, which move the insert material into the envelope E. During this movement, the switch actuator 162 moves downwardly to actuate the switch 160 and back to its normal position after the trailing edge of the insert package passes the switch actuator 162 for a purpose fully described hereinbelow.

Figure 13:
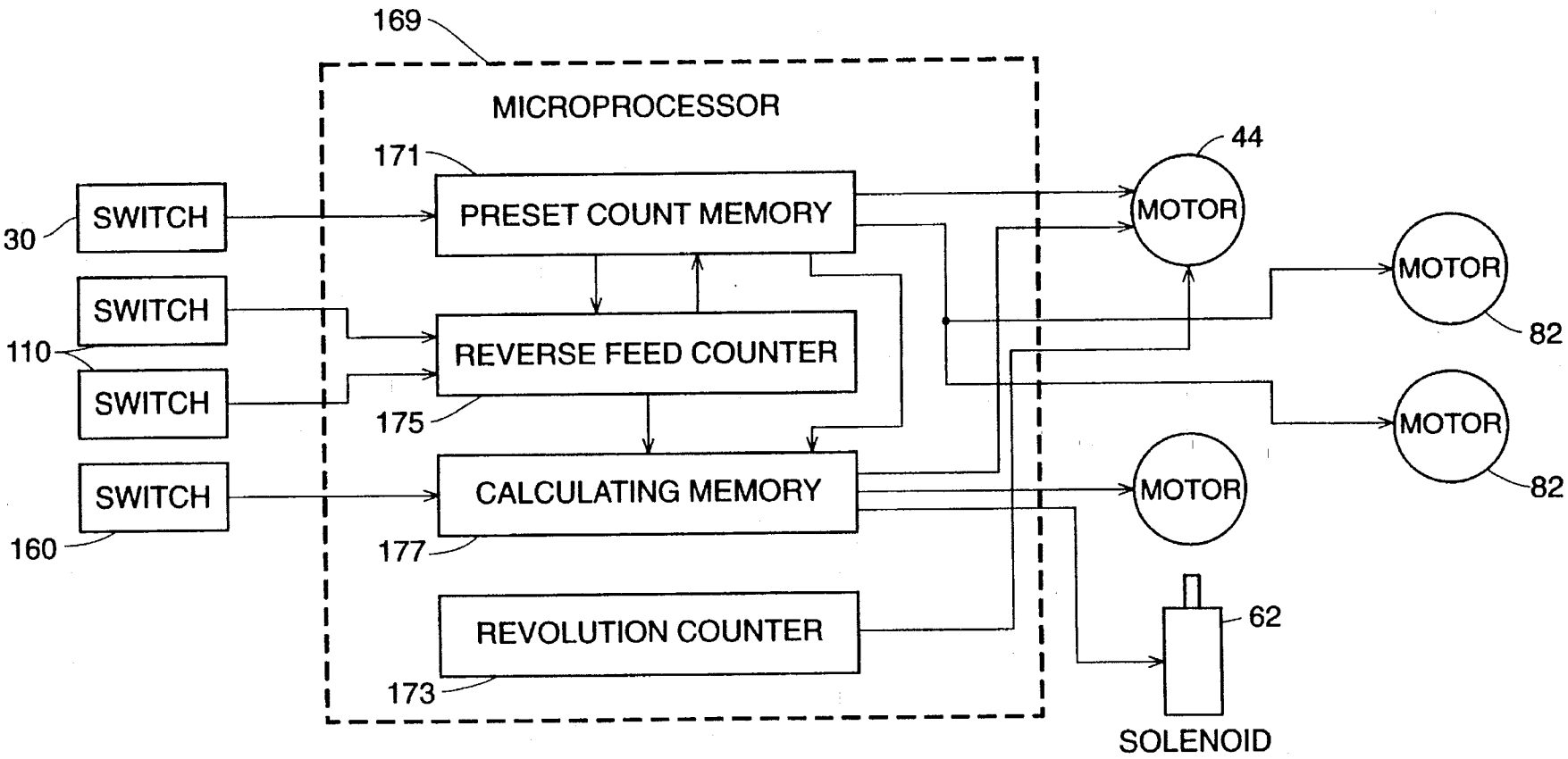
FIG. 13 is a relatively simple schematic diagram of the electrical and electronic control components of the apparatus embodying the present invention.

FIG. 13 is a relatively simple schematic diagram which illustrates the manner in which the above described switching and driving components interact through a microprocessor to control the movements and positioning of an envelope to establish a predetermined insert material receiving location for a first envelope to which all succeeding envelopes having the same shape and throat characteristics will be fed by the positioning apparatus 10. Thus, with reference to FIGS. 1, 6, and 8 through 13, a complete cycle of operation of the envelope positioning apparatus 10 will now be described. When an envelope E is initially fed into the portion of the feed path represented by the guide plates 14 and 18, it moves the sensing lever 22 which actuates the lead edge sensing switch 30, in response to which a microprocessor 169 actuates the stepper motor 44 which drives the envelope E for a predetermined distance along the feed path until the lead edge thereof reaches a first predetermined location, indicated by the line designated 170 in FIG. 8, at which the upper edge 172 of the non-flapped surface of the envelope is at a location beyond the point where the hooks 92 can engage the upper edge 172, which is designated by the line 174 in FIG. 8. The predetermined distance traveled by the envelope is represented by a preset number of electronic counts stored in a suitable memory 171 in the microprocessor, and when the stepper motor 44 has been driven by this number of counts, the microprocessor 169 stops it to arrest the movement of the envelope E with the lead edge thereof at the line 170 location.

At this point, the memory 171 also causes the microprocessor 169 to actuate the picker drive motors 82 to start operation of the picker assemblies 70 as above described. Since the upper edge 172 of the non-flapped surface of the envelope E has passed beyond the point where the hooks 92 can engage the upper edge 172, as seen in FIG. 9, the picker switches 110 in the throat opening devices 70 remain open, and the picker motor 82 remains energized to operate the hooks 92 through successive cycles. However, each time the motors 82 drive the hooks 92 through one complete one cycle, a suitable sensing device 173 causes causes the microprocessor 169 to acuatuate the stepper motor 44 momentarily in a reverse direction from that in which it fed the lead edge of the envelope E to the line 170 position so as to feed the envelope E a small increment of movement in the opposite direction to bring the upper edge 172 closer to the hooks 92. The picker motors 82 remain energized during this reverse movement of the envelope E and continue to cycle the hooks 92 through their movement as described above, and each time the throat opening devices 70 complete one cycle without the hooks 92 engaging the upper edge 172 of the envelope E, the microprocessor actuates the stepper motor 44 to move the envelope E another increment in the reverse direction toward the hooks 92. Eventually, depending on the shape and throat characteristics of the envelope, which can vary considerably as seen from the examples illustrated in FIGS. 3, 4 and 5, the lead edge of the envelope 172 will have moved in the reverse direction to a third predetermined location, designated by the line 176 in FIG. 8, which moves the upper edge 172 of the envelope E to the position indicated by the line 178 in FIG. 8. At this point, the upper edge 172 of the envelope is sufficiently close to the hooks 92 that the upper portion 92*c* thereof will engage the upper edge 172 of the envelope as seen in FIG. 10, and further movement of the hooks 92 in their cycle of operation will open the throat of the envelope and also close the switches 110 of the throat opening assemblies 70 to indicate to the microprocessor 169 that the throat of the envelope is now open and ready to receive the package of insert material.

The microprocessor 169 includes a suitable counter 175 for recording the number of counts that the stepper motor 44 moves to move the envelope E in the reverse direction to bring the lead edge thereof to the line 176 position. Also a suitable memory 177 is provided which calculates the difference between the preset number of counts in the memory 171 and the number of counts recorded by the counter 175, and stores this difference. Once the insert material is inserted into the first envelope E and it is ejected from the insertin machine, the microprocessor 169 will cause the stepper motor 44 to immediately bring all subsequent envelopes having the same size and throat characteristics as the first envelope to the position at which the hooks 92 will immediately engage the upper edge 172 and open the throat of each succeeding envelope. Thus, the microprocessor actually adjusts the preset number of counts by which the stepper motor 44 is actuated to feed the first envelope through the predetermined distance to move the lead edge thereof from the point at which the switch 30 is actuated to the lead edge of the envelope to the position 170 in FIG. 8 by the number of counts that the stepper motor 44 moves the envelope in the reverse direction to move the lead edge thereof from the position 170 to the position 176. By subtracting the second number of counts from the preset number of counts, the microprocessor determines the number of counts which are required to actuate the stepper motor 44 to move the lead edges of succceeding envelopes having the same shape and throat characteristics from the point at which the switch 30 is actuated directly to the position 176, thereby placing the succeeding envelopes in the insert material receiving location for envelopes having that shape and throat characteristics.

Once the insert material receiving location of the envelope is determined by the above procedure, the switches 110 signal the microprocessor that the envelope is in position to receive the insert material, and the microprocessor energizes the motor that drives the D-roller shaft 140 and the shaft 148 which in turn drives the pulley 150 to drive the belt 144, thereby moving the insert material into the envelope E as shown in FIG. 12. As the insert material moves over the switch actuator 162 and depresses it, the switch 160 is actuated, but nothing happens until the trailing edge of the insert material passes over the switch actuator 162 and allows it to return to the position shown in FIG. 6. This movement causes the switch 160 to signal the microprocessor that the insert material has been moved into the envelope E, in response to which the microprocessor again energizes the motor 44 to drive the belt 40, and simultaneously energizes the solenoids 62 to raise the roller 54 so that the envelope E with the insert material therein is pressed against the belt 40 in driving engagement therewith and is ejected from the envelope positioning apparatus 10.

Once the insert material receiving location of the envelope is determined by the procedure above described for the first envelope, all succeeding envelopes are automatically fed to that location, and the envelope feeding and inserting cycles continue without interruption so long as envelopes having the same shape and throat characteristics are fed to the positioning apparatus 10. In the event that an envelope having a different shape and/or throat characteristics is fed into the same run, or a new run is started, and the picker assemblies fail to open the throat of the new envelope, the microprocessor recognizes the failure of the throat opening assemblies 70 to open the throat of the envelope and it starts the foregoing cycle for determining a new insert material receiving location.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. An envelope positioning apparatus for positioning envelopes having various shape and throat characteristics in an inserting machine so that the envelope throats can be opened for receiving insert material regardless of variations in the shape and throat characteristics of envelopes that are successively fed into the inserting machine, said envelope positioning apparatus comprising:

A. guide means defining a feed path along which envelopes are adapted to be fed and to be disposed in a predetermined insert material receiving location for receiving insert material therein, B. means for feeding envelopes along said feed path, C. means disposed along said feed path for opening the throat of envelopes that are in an insert material receiving location that is appropriate for the shape and throat characteristics of the envelopes being fed along said feed path, D. sensing means disposed at a first predetermined location along said feed path for sensing the arrival of the lead edge of a first envelope at a first predetermined location, and E. microprocessor control means operable in response to said sensing means sensing the arrival of the lead edge of said first envelope at said first predetermined location for 1. causing said feeding means to position said first envelope at a first insert material receiving location that is appropriate to the shape and throat characteristics of said first envelope, 2. causing said feeding means to feed successive envelopes having the same shape and throat characteristics as said first envelope to be fed to said first insert material receiving location, and 3. causing said feeding means to feed successive envelopes having shape and/or throat characteristics different from those of preceding envelopes to be fed to a second insert material receiving location that is appropriate to said different shape and/or throat characteristics, whereby each succeeding envelope fed into said inserting machine having the same shape and throat characteristics as said first envelope will be positioned at said first insert material receiving location, and other envelopes having different shape and/or throat characteristics will be automatically positioned at said second insert material receiving location that is appropriate to the different shape and throat characteristics of said other envelopes to receive insert material thereat.

2. An envelope positioning apparatus as set forth in claim 1 wherein said means for feeding said envelopes along said feed path comprises a pair of cooperating feed rollers, one of which is driven by a stepper motor that is under the control of said microprocessor control means.

3. An envelope positioning apparatus as set forth in claim 2 wherein said microprocessor control means includes means responsive to said sensing means sensing the arrival of said lead edge of said first envelope at said first location for actuating said stepper motor to feed said first envelope along said feed path a predetermined distance until said lead edge thereof reaches a second predetermined location at which said first envelope is beyond said first insert material receiving location.

4. An envelope positioning apparatus as set forth in claim 3 wherein

A. said sensing means for sensing the arrival of the lead edge of a first envelope at a first predetermined location comprises a switch having an actuator disposed in the path of movement of said first envelope so as to actuate said switch when said lead edge of said first envelope contacts said actuator, and B. said microprocessor control means for actuating said stepper motor comprises means for operating said stepper motor for a preset number of counts stored in said microprocessor to feed said first envelope said predetermined distance to move said lead edge thereof from said first predetermined location to said second predetermined location.

5. An envelope positioning apparatus as set forth in claim 3 wherein said microprocessor control means further includes means responsive to said lead edge of said envelope arriving at said second predetermined location for actuating said stepper motor to feed said first envelope in a reverse direction from that in which said lead edge of said first envelope arrived at said second predetermined location until said lead edge of said envelope is in a third predetermined location at which said envelope is at said first insert material receiving location.

6. An envelope positioning apparatus as set forth in claim 5 wherein said means for opening the throat of envelopes that are positioned in said insert material receiving location includes means for sensing when said lead edge of said first envelope arrives at said third predetermined location.

7. An envelope positioning apparatus as set forth in claim 6 wherein said microprocessor control means further includes means responsive to operation of said means for sensing when said lead edge of said first envelope arrives at said third predetermined location for deactuating said stepper motor to arrest the movement of said first envelope at said first insert material receiving location.

8. An envelope positioning apparatus as set forth in claim 7 wherein said microprocessor control means further includes memory means for recording and storing the number of counts that said stepper motor feeds said first envelope in said reverse direction to move said lead edge of said first envelope from said second predetermined location to said third predetermined location.

9. An envelope positioning apparatus as set forth in claim 8 wherein said microprocessor control means further includes means for adjusting the number of counts that said stepper motor is actuated to feed said first envelope through said predetermined distance to move the lead edge thereof from said first predetermined location to said second predetermined location by the number of counts that said stepper motor moves said first envelope in said reverse direction to move the lead edge thereof from said second predetermined location to said third predetermined location so that successive envelopes having the same shape and throat characteristics are fed by said stepper motor along said feed path so that the lead edges thereof are moved directly from said first predetermined location to said third predetermined location to place said successive envelopes in said first insert material receiving location.

* * * * *